US008813962B1

(12) United States Patent
Winikoff

(10) Patent No.: US 8,813,962 B1
(45) Date of Patent: Aug. 26, 2014

(54) HOLDER FOR USED BAGS

(71) Applicant: Robert Winikoff, Cote Ste. Luc (CA)

(72) Inventor: Robert Winikoff, Cote Ste. Luc (CA)

( * ) Notice: Subject to any disclaimer, the term of this patent is extended or adjusted under 35 U.S.C. 154(b) by 0 days.

(21) Appl. No.: 13/986,691

(22) Filed: May 24, 2013

(51) Int. Cl.

| | |
|---|---|
| ***B65D 1/34*** | (2006.01) |
| ***B65D 33/00*** | (2006.01) |
| *B65D 33/04* | (2006.01) |
| *A47F 9/04* | (2006.01) |
| *A47F 1/08* | (2006.01) |

(52) U.S. Cl.
CPC ..... *B65D 33/001* (2013.01); *B65D 33/04* (2013.01); *A47F 9/042* (2013.01); *A47F 1/08* (2013.01)
USPC ..... 206/554; 221/63

(58) Field of Classification Search
CPC ..... B65D 33/001; B65D 33/04; A47F 9/042; A47F 1/08
USPC ..... 206/449, 494, 554; 221/45, 49, 63; D34/1
See application file for complete search history.

(56) References Cited

U.S. PATENT DOCUMENTS

| | | | | |
|---|---|---|---|---|
| 849,893 | A * | 4/1907 | Frear | 221/63 |
| 985,235 | A * | 2/1911 | Walter | 221/63 |
| 3,743,372 | A * | 7/1973 | Ruggerone | 312/108 |
| 5,002,200 | A * | 3/1991 | Hunt | 206/554 |
| 5,042,687 | A * | 8/1991 | McKinley | 221/45 |
| D329,344 | S | 9/1992 | Carillo | |
| 5,386,910 | A * | 2/1995 | Liss | 206/554 |
| 5,570,808 | A * | 11/1996 | Tassoni | 221/63 |
| 5,957,325 | A * | 9/1999 | Montanez | 221/131 |
| D419,010 | S | 1/2000 | Hansen et al. | |
| D482,915 | S | 12/2003 | Yang | |
| D507,715 | S | 7/2005 | Yang | |
| 6,915,907 | B2 * | 7/2005 | Myers | 206/782 |
| 7,044,329 | B2 | 5/2006 | Lum | |
| 7,172,092 | B2 | 2/2007 | Yang | |
| 7,588,168 | B2 * | 9/2009 | Bagwell et al. | 221/96 |
| 7,654,409 | B2 * | 2/2010 | Hoffmann | 206/554 |
| 7,717,293 | B2 | 5/2010 | Bellafatto | |
| D681,986 | S | 5/2013 | Murphy | |

* cited by examiner

*Primary Examiner* — Luan K Bui

(57) ABSTRACT

A holder for used plastic bags having at least two tubular containers, one container larger than the other. The larger container is used for storing bags that are larger than the bags stored by the other container. Each container has a first opening at one end of the container for passing bags into or out of the container and a second opening at the other end of the container for passing bags into or out of the container. The openings are at least large enough for a user to insert his thumb and a finger within the container to be able to withdraw a bag from within the container. There is a slot in each container between the openings allowing a member to be inserted into the container to move bags within the container toward either opening. The holder can be mounted with either end at the top, normally forming an inlet for the bags while the opening at the bottom forms an outlet.

9 Claims, 4 Drawing Sheets

HOLDER FOR USED BAGS

BACKGROUND OF THE INVENTION

1. Field of the Invention

This invention is directed toward a holder for used bags. The invention is more particularly directed toward a holder for used plastic bags, the holder holding bags in at least two groups, the bags in each group of different size from the bags in the other groups.

2. Description of the Related Art

Holders for used plastic bag are known. They comprise a single, elongated, tubular, container, adapted to be mounted vertically, with an inlet at the top and an outlet at the bottom. The used plastic bag is crumpled into a rough ball shape and stuffed into the container through the inlet. The initial bag is moved down through the container as additional bags are loaded into the container through the inlet. The initial bag can normally be removed through the outlet when needed. A slot is provided in the wall of the container, the slot extending nearly over the length of the container and parallel to the longitudinal center line of the container. A pushing member can be inserted through the slot into the container to move the bags down toward the outlet if needed. A bag can also be removed from the container, if desired, back out through the inlet, when pushed up to the inlet through the slot, or even directly through the slot.

The known bag holders have several disadvantages. Bags of varying size can be loaded into the holder, and if the user is looking for a small bag, one or more larger bags may have to be removed from the holder before a small bag is retrieved. The larger bags then have to be reinserted into the holder. It can also be difficult to load bags into the holder through the inlet since plastic bags are difficult to maintain compressed while loading. The bags immediately tend to expand when released from the compressed state in loading the bag through the inlet making it difficult to push them into the inlet.

BRIEF SUMMARY OF THE INVENTION

It is the purpose of the present invention to provide a bag holder with at least two and preferably three, tubular containers of different size. The three containers each receive, store, and dispense used plastic bags within a range of sizes normally different from the range of the sizes of the bags stored by the other containers. The largest container will receive, store and dispense a range of the largest, used bags. The next largest container will receive, store and dispense a range of intermediate sized, used bags and the smallest container will receive, store and dispense a range of the smallest, used bags.

The containers are preferably of generally quadrangular cross-sectional shape, each container having front and rear walls joined by side walls. The containers are connected, preferably adjacent each other, with the middle sized container normally between the largest and smallest containers. The containers are connected so that at least two of the containers have their rear walls aligned so that the aligned rear walls can be mounted flat against a vertical surface such as a wall or door. Preferably, all three rear walls are aligned.

The bag holder has mounting means for mounting the holder with the containers in an upright position. Each end of each container in the holder is partially closed by an end wall. The end wall normally leaves a bag opening between the end wall and the front of the container. The ends of each container are the same so that the bag holder can be mounted with either end of the containers on top. The bag opening at the top normally provides a bag inlet and the bag opening at the bottom normally provides a bag outlet. The bag openings preferably have an area about two thirds of the cross-sectional area of the container they are in.

The ends of the containers can be transverse to the longitudinal axis of the containers. Preferably however, at least the top end of each container, including the top end wall, is angled downwardly and forwardly from the rear of the container. The bottom end of each container, including the bottom end wall, is also preferably angled upwardly and forwardly, from the rear of the container. The top end wall helps a user compress a bag to be loaded into a container, and, being angled downwardly and forwardly, helps guide the compressed bag into the inlet making loading of the bag easier. The angled top end also makes the inlet opening more visible making loading easier. The angled ends of each container in the holder are the same so that the holder can be used inverted.

In another embodiment, each angled end wall can be located within the container, spaced a short distance from the end of the container. The front wall area of the container, between the said end of the container and the angled end wall, within the container, cooperates with the angled end wall to help increasingly compress the bag while inserting the bag into and through the inlet opening into the container.

The invention is particularly directed toward a holder for used plastic bags having at least two tubular containers, one container larger than the other. The one container is used for storing larger bags than the bags stored by the other container. Each container has a first opening at least near one end for passing bags into or out of the container and a second opening, spaced from the first opening, at least near the other end for passing bags into or out of the container. The openings in the container are at least large enough for a user to insert his thumb and at least one finger within the container to be able to withdraw a bag from within the container. There is a slot in each container between the openings allowing a member to be inserted into the container to move bags within the container toward either opening.

One end of each container is partially closed by a first end wall extending forwardly from the rear of the container toward the front of the container to form the first opening in the container between the first end wall and the front of the container. The other end of each container is partially closed by a second end wall extending forwardly from the rear of the container toward the front of the container to form the second opening in the container between the second end wall and the front of the container. Each end of each container, including the end wall associated with the end, may be angled toward the other end of the container. Each angled end wall in each container may be spaced a short distance inwardly from the end of the container associated with the end wall. The end of the container associated with the inside angled end wall may be square or angled.

DETAILED DESCRIPTION OF THE INVENTION

Figure 1:
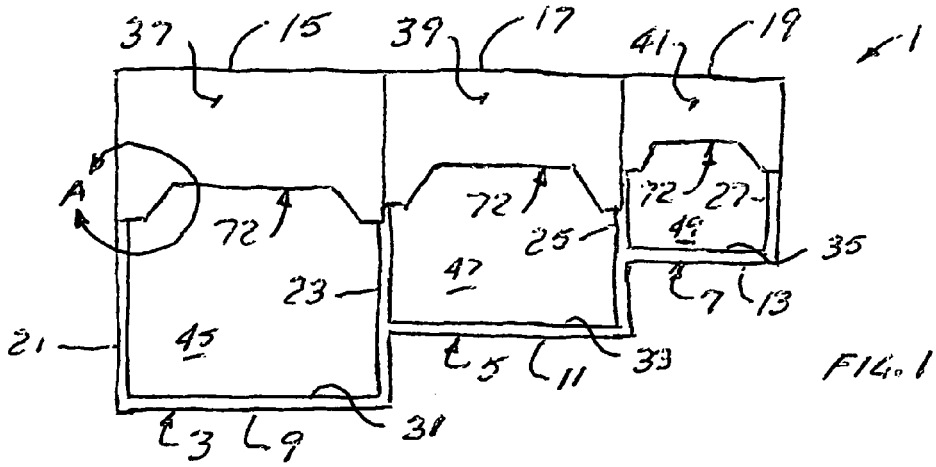
FIG. 1 is a top view of the bag holder.
Figure 3:
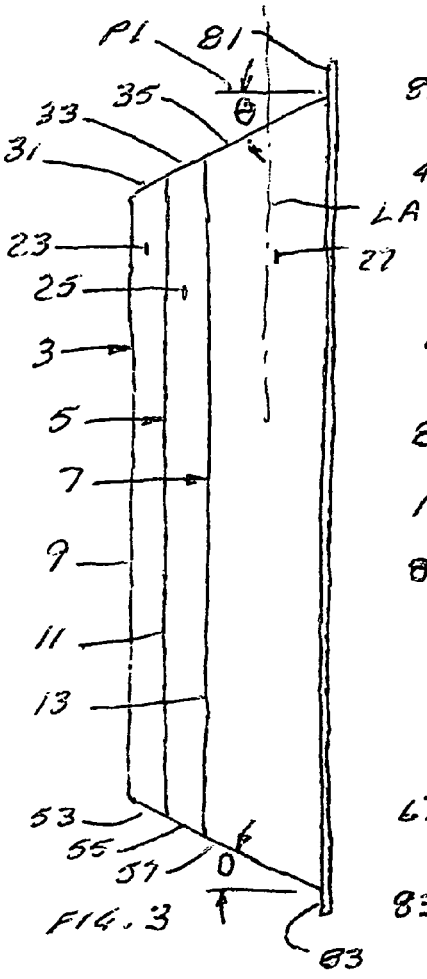
FIG. 3 is a side view of the bag holder.
Figure 2:
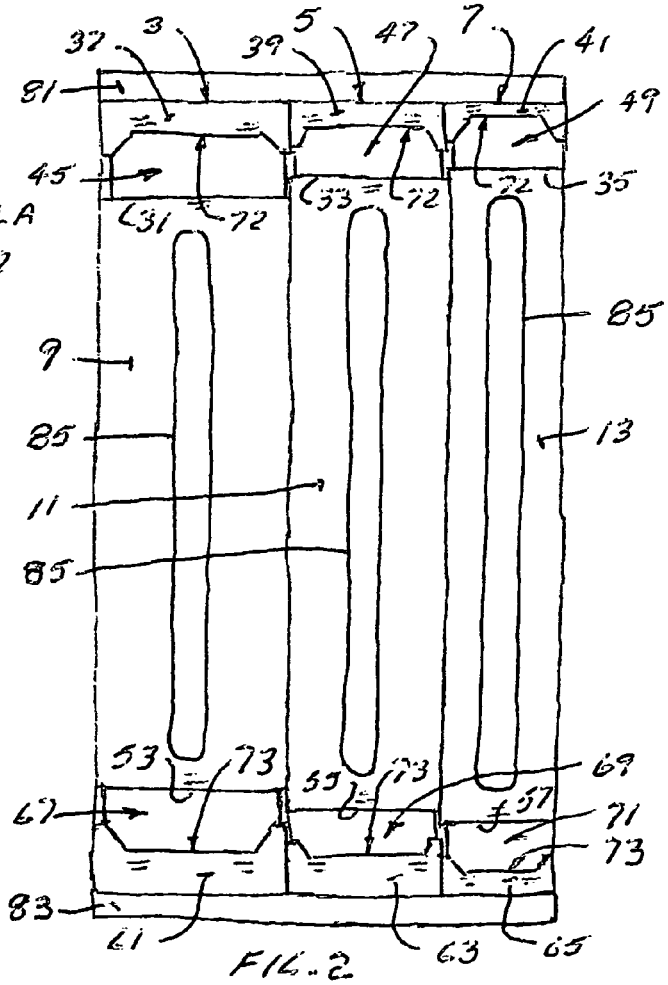
FIG. 2 is a front view of the bag holder.

The bag holder 1 shown in FIGS. 1-3 has three, tubular containers 3, 5, 7 side by side. Container 3 is the largest, container 5 is the next largest and container 7 is the smallest. The containers have a similar construction but differ in cross-sectional area, with container 3 having the largest area, container 7 the smallest area, and container 5 an area roughly midway between the areas of containers 3 and 7. The container 3 receives the largest bags, container 7 the smallest bags, and container 5 the mid-size bags. The three containers 3, 5, 7 as shown in FIG. 1, each have a rectangular cross-section having front walls 9, 11, 13 respectively and rear walls 15, 17, 19 respectively. The bag holder 1 has four side walls 21, 23, 25, and 27 join the front and rear walls together to form the containers 3, 5, 7. Side walls 21, 23 are the widest and join the largest front and rear walls 9, 15 together forming the largest container 3. Side walls 23, 25 join front and rear walls 11, 17 together forming the next widest container 5. Side wall 23 is common to both containers 3, 5. Side walls 25, 27 join the narrowest front and rear walls 13, 19 together forming the smallest container 7. Side wall 25 is common to both containers 5, 7.

The rear walls 15, 17, 19 of the containers 3, 5, 7 are aligned. The front walls 9, 11, 13 of the containers 3, 5, 7 are parallel to each other and to the rear walls but are staggered with front wall 11 spaced slightly to the rear from front wall 9 and with front wall 13 spaced slightly to the rear from front wall 11.

The containers 3, 5, 7 each have a first open end 31, 33, 35 respectively, partly closed by first end walls 37, 39, 41 respectively, as shown in FIG. 1. The first end wall 37, 39, 41 for each container extends from the rear wall 15, 17, 19 respectively, forwardly to close about a third of the ends 31, 33, 35, leaving a first opening 45, 47, 49 in the first ends of each container 3, 5, 7 respectively. The containers 3, 5, 7 each have a second open end 53, 55, 57 respectively, opposite the first ends 31, 33, 35 respectively, partly closed by second end walls 61, 63, 65 respectively as shown in FIG. 2. The second end wall 61, 63, 65 for each container extends forwardly from each respective rear wall 15, 17, 19 to close about a third of each of the second ends 53, 55, 57 leaving a second opening 67, 69, 71 in the second ends of each container 3, 5, 7 respectively. While the end walls have been said to close about a third of the open ends, they can close between about a quarter and about a half of the open ends.

The first end walls 37, 39, 41 can be formed as a single, first, end wall member 72 and attached to the first ends of the side walls 21, 23, 25, 27 while the second end walls 61, 63, 65 can also be formed as a single, second, end, wall member 73 and attached to the second ends of the side walls 21, 23, 25, 27. Both ends of the containers are the same. Either set of ends, 31, 33, 35 or 53, 55, 57, can be at the top with the other set of ends at the bottom when the support 1 is in use, mounted on a vertical surface.

The first ends 31, 33, 35 and the second ends 53, 55, 57 of the containers 3, 5, 7, and the end walls closing part of the ends, can be square, extending transversely to the longitudinal axis of the containers. Preferably however, the ends of the containers, including the end walls, are angled slightly toward each other as shown in FIG. 3. The first ends 31, 33, 35 could be angled downwardly and forwardly, at an angle θ of about 30° to a first plane P1 passing transversely to the longitudinal axis LA of the container 7, from where the end joins the rear of the containers. The angle θ could range between about 15° and 45°. The second ends 53, 55, 57 could be angled upwardly and outwardly at the same angle θ of about 30°. Again, the angle for the second ends would have the same range as the angle for the first ends. The angling of the first and second ends makes the openings 45, 47, 49 and 67, 69, 71, in the ends more visible and accessible, making it easier to insert bags into the containers, or to remove bags from the containers, through the openings. The angling of the ends also helps the end walls at the top of the containers to direct the bags into the openings, the walls sloping toward the openings.

Figure 4:
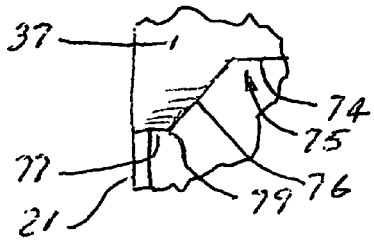
FIG. 4 is a detail view of what is shown within 'A' in FIG. 1.

The free end edges 74 of the first end walls 37, 39, 41 and the second end walls 61, 63, 65 can be scalloped inwardly as shown at 75 in FIG. 4 leaving forwardly extending, outwardly angled, side shoulders 76. The shoulders 76 can be slightly truncated as shown at 77. The scalloped free end edges 74 increase the size of the openings making movement of a bag into or out of the container easier. If the shoulders are slightly truncated, the corners 79 formed by the truncated shoulders 76 helps retain bags within the bottom of the containers. The free end edges 74 of the end walls could also be dished or curved rearwardly from side to side, in place of being scalloped, eliminating the shoulders 76.

The rear walls 15, 17, 19 can extend a short distance past the first and second ends 31, 33, 35 and 53, 55, 57, as shown in FIGS. 2 and 3, to provide mounting means in the form of fastening flanges 81, 83 at each end of holder 1 for use in fastening the holder to a surface such as a wall or door.

Each container 3, 5, 7 in the holder has a longitudinal slot 85 in the front of the container extending over a major portion of the length of the container, each slot parallel to the longitudinal center line of the container. Each slot is wide enough to receive a user's finger, the finger insertable through the slot into the container and slid along the slot to move bags in the container to the either end of the container. A slender rigid article could be used instead of the user's finger to move bags inside the container. The user could withdraw a bag from within the container through the slot.

Figure 5:
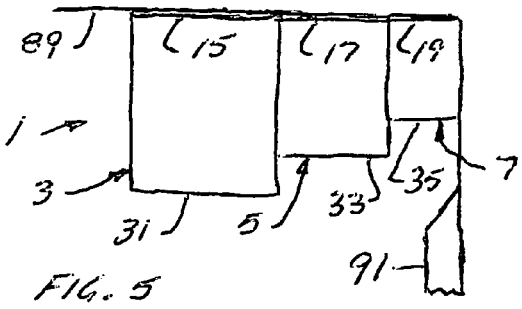
FIG. 5 is a top view showing the bag holder mounted in one position.
Figure 6:
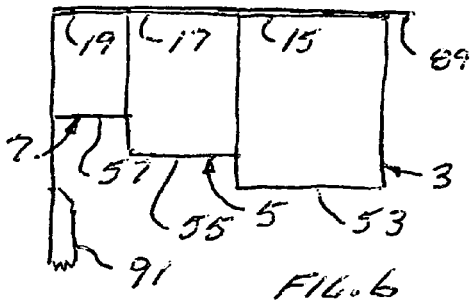
FIG. 6 is a top view showing the bag holder mounted in a second position.

The holder 1 can be mounted flat on a vertical surface 89, the rear walls 15, 17, 19 against the surface 89, the containers 3, 5, 7 extending vertically, as shown in FIGS. 5 and 6. The holder 1 can be mounted with either the first 31, 33, 35 or second 53, 55, 57 set of ends of the containers at the top. For the mounted holder 1 shown in FIG. 5, with the first set of ends 31, 33, 35 at the top, the largest container 3 is at the left. If the holder is instead inverted and mounted with the second set of ends 53, 55, 57 at the top, as shown in FIG. 6, the largest container 3 is at the right. The construction provides some flexibility in mounting the holder particularly in places where there may be obstructions 91 interfering with mounting the holder in one position but not in another position.

Figure 7:
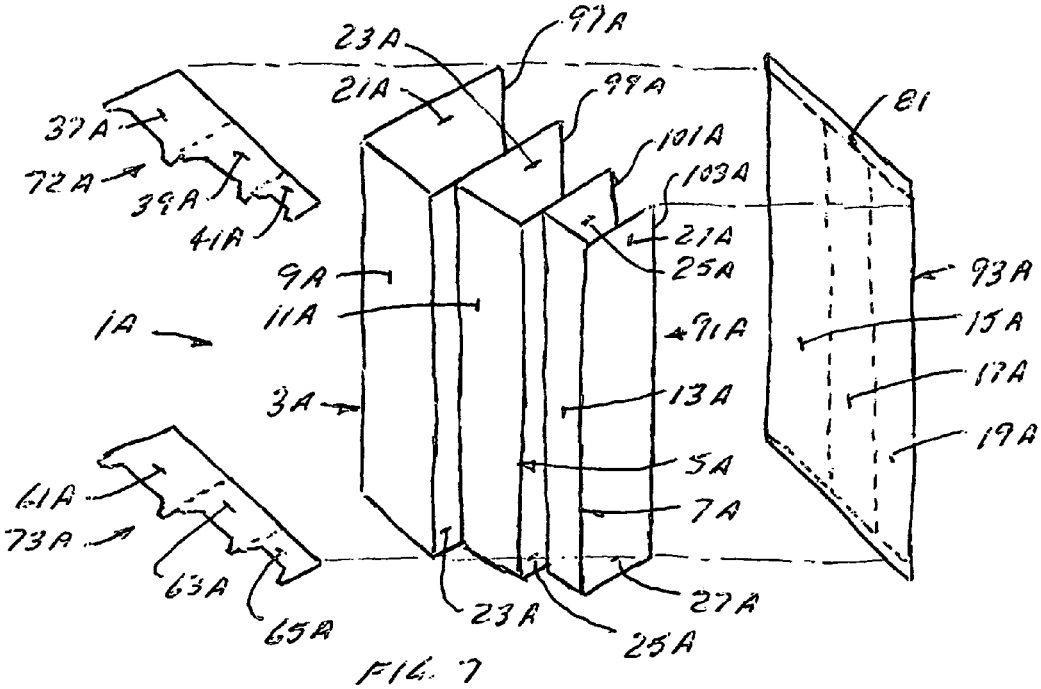
FIG. 7 is an exploded, perspective view of another embodiment of the bag holder.

The holder can be made in sections, as shown by the holder 1A in FIG. 7, with a molded or extruded front section 91A having the front walls 9A, 11A, 13A and the side walls 21A, 23A, 25A, 27A, which form part of the containers 3A, 5A, 7A, making up the holder LA. Holder 1A includes a rear wall section 93A, comprising a flat panel, closing the back of the front section 91A and providing the rear walls 15A, 17A, 19A of the containers 3A, 5A, 7A. The rear wall section 93A abuts on the free side edges 97A, 99A, 101A, 103A of the side walls 21A, 23A, 25A, 27*a* respectively. Each end of each container can be square as before or can be angled forwardly toward the front walls and downwardly toward the other end of the container. The holder 1A can include a first end wall member 72A providing first end walls 37A, 39A, 41A, and a second end wall member 73A providing second end walls 61A 63A, 65A. The end wall members 72A, 73A can be attached to the side walls 21A, 23A, 25A, 27A and the rear wall section 93A. Alternatively, the first and second end wall members 72A, 73A could be molded integrally with the front section 91A and attached to the rear wall section 93A, or they could be molded integrally with rear wall section 93A and attached to the front section 91A. The end wall members 72A, 73A form the first and second openings in the ends of the containers. The ends of the holder 1A are the same. Thus the holder 1A can be inverted when installing it if needed.

Figure 8:
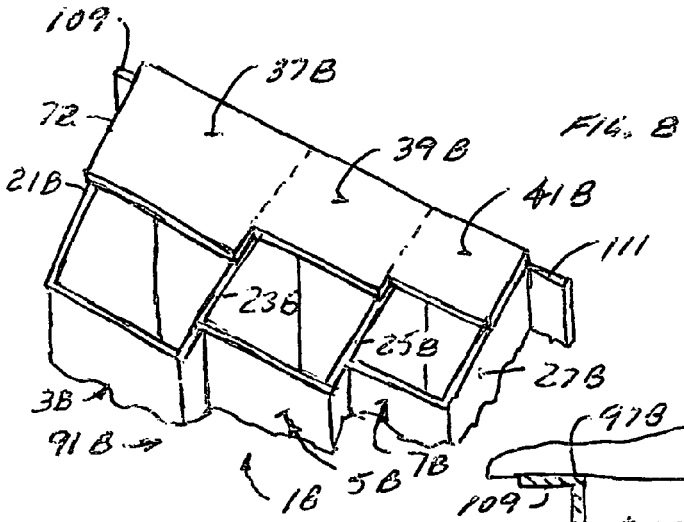
FIG. 8 is a partial, perspective view of yet another embodiment of the bag holder.
Figure 9:
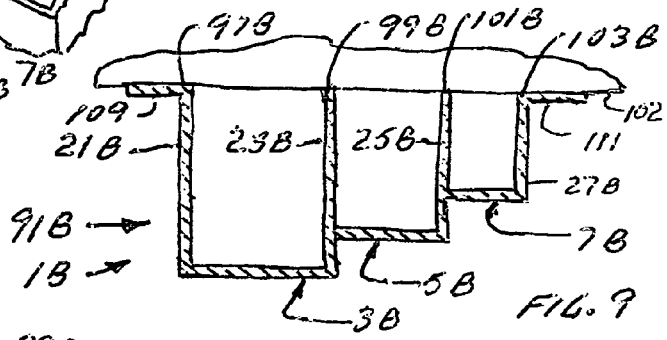
FIG. 9 is a cross-section view of the bag holder shown in FIG. 8 mounted on a vertical surface.

The holder can also comprise a modified front section 91B as shown by the holder 1B in FIGS. 8 and 9. In this embodiment the front section 91B can have mounting means in the form of side flanges 109, 111 extending laterally from the free side edges 97B, 103B of the outer side walls 21B, 27B of the front section 91B. The front holder section 91B, with the integral flanges 109, 111, can be mounted to a flat surface 102 with the free side edges 97B, 99B, 101B, 103B of all the side walls 21B, 23B, 25B, 27B respectively abutting the surface 102 and with the flanges 99, 101 flat against the surface 102. Suitable fasteners (not shown) are passed through the flanges 99, 101 into the surface 102 to mount the holder section 91B onto the surface 102. The surface 102 acts as a rear wall and closes the open rear side of the front section 91B to form the containers 3B, 5B, 7B. Both ends of the containers are provided with end walls to help form the inlet/outlet openings. The end walls can be provided by end wall members similar to end wall members 72A, 73A. One end wall member 72B is shown providing end walls 37B, 39B, 41B. The ends of the containers 3B, 5B, 7B can be square or angled toward each other.

Figure 10:
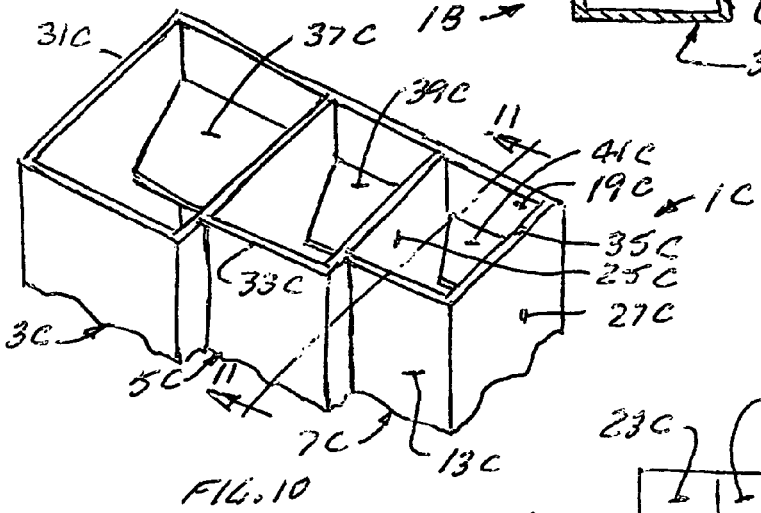
FIG. 10 is a partial perspective view of another embodiment of a bag holder.
Figure 11:
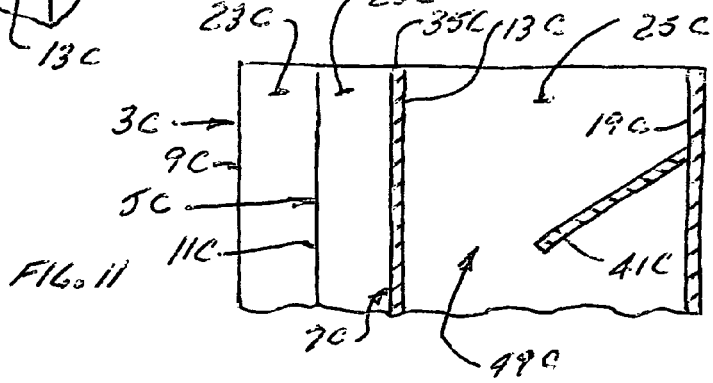
FIG. 11 is a cross-section view taken along line 11-11 in FIG. 10.

In another embodiment, bag holder 1C can have the end walls recessed a short distance from the ends of the containers. As shown in FIGS. 10 and 11, the first end walls 37C, 39C, 41C are mounted within the containers 3C, 5C, 7C respectively, spaced a short distance from the ends 31C, 33C, 35C of the containers. The first end walls extend forwardly from the rear walls 15C, 17C, 19C and are shown angled downwardly. The ends 31C, 33C, 35C in this embodiment are shown as being square, but they could also be angled as previously described. The angle of the ends could be the same as the angle of the recessed end walls or slightly different. The recessed mounting allows the other walls of each container, and particularly the front wall, to help with the angled wall to compress the bag when it is being inserted into a container. As shown in the FIGS. 10 and 11, using container 7C as an example, the front wall 13C of the container along with the side walls 25C, 27C, cooperate with the downwardly angled end wall 41C to increasingly compress a plastic bag as it is moved into the container and down the end wall toward and through the inlet opening 49C.

Figure 12:
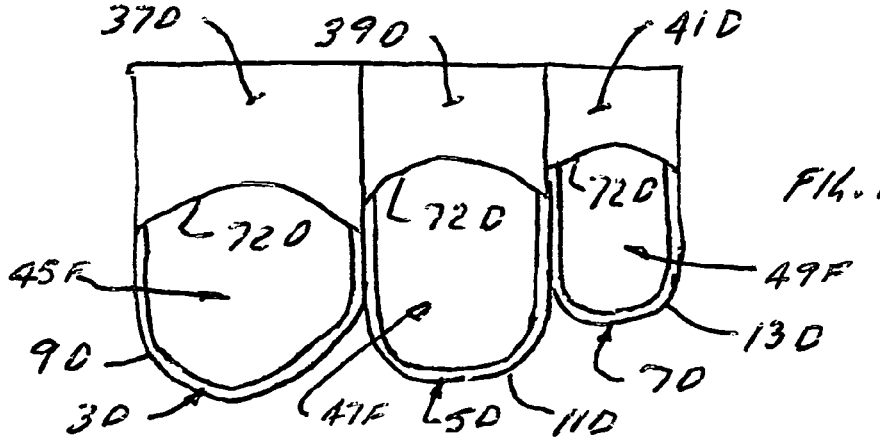
FIG. 12 is a top view of another embodiment of the bag holder.

In all embodiments the first and second openings, providing either an inlet or outlet, are at least large enough for a user to be able to insert a thumb and at least one finger of one hand within the opening to grasp and withdraw a bag from within the container. To make it easier to insert and remove a bag from a container, the front walls 9D, 11D, 13D of the containers 3D, 5D, 7D can be rounded outwardly as shown in FIG. 12. The free edge 72D of the end walls 37D, 39D, 41D, are rounded inwardly over their length. Together, the free edge 72D of the end wall of each container, at each end, cooperates with the rounded front wall 9D, 11D, 13D of the containers 3D, 5D, 7D to form a relatively large, somewhat circular-like, opening 45D, 47D, 49D at the front end of each container making insertion and removal of the bags easier.

Figure 13:
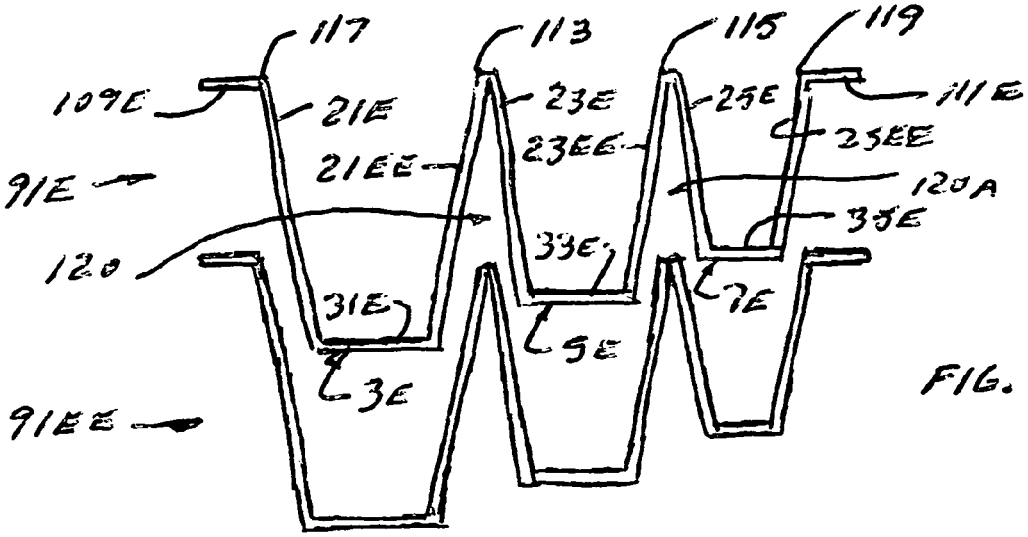
FIG. 13 is a cross-section view of two identical front holder sections, in another embodiment, about to be stacked one within the other.

In another embodiment of the invention the front sections 91A, 91B of the holders can be modified so that the front sections are stackable. As shown in FIG. 13, the front section 91E can be formed with the container sections 3E, 5E, 7E having trapezoidal cross-sections with the front wall 31E, 33E, 35E, of the container sections being the shorter of the two parallel lengths defining part of the trapezoidal cross-sectional shape. Each container section 3E, 5E, 7E has its own two side walls 21E, 21EE; 23E, 23EE; 25E, 25EE respectively. The two side walls of each section extend rearwardly from the ends of the front wall of each section, diverging slightly away from each other. The side walls 21EE and 23E of sections 3D, 5D, meet and join at a point 113 and the side walls 23EE and 25E of sections 5D, 7D meet and join at a point 115. The free edges 117, 119 of the outer side walls 21E, 25EE and the points 113, 115 are aligned. The side walls 21EE, 23E define a first, narrow, triangular opening 120 and the side walls 23EE, 25E define a second narrow triangular opening 120A. The front sections 91E are stackable with the container sections 3E, 5E, 7E of each front section insertable into the corresponding container sections of the front section 91EE below it. The front sections 91E have angled ends, to form invertable supports, facilitating stacking of the front sections. In one embodiment, the front sections 91E, after removal from the stack, can be closed by separate, planar, rear sections, similar to rear section 93A shown in FIG. 7. In another embodiment, as shown, the front sections 91E can have lateral extending flanges 109E, 111E allowing the front sections to be fastened to a wall surface. The wall surface closes the containers sections providing rear walls to form the containers. The ends of the container sections can be provided with partial end walls forming the inlet/outlet openings in each end of each container.

Figure 14:
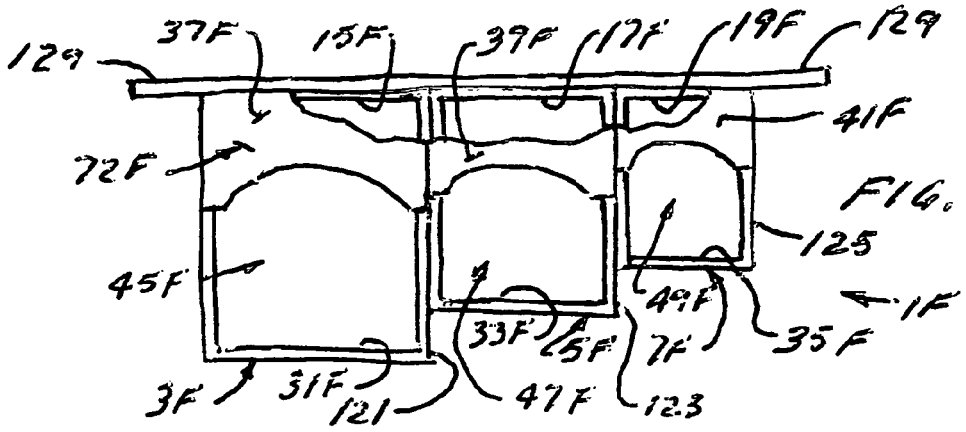
FIG. 14 is a top view, partially broken away, of yet another embodiment of the holder.

In a further embodiment the holder 1F can be formed from containers 3F, 5F, 7F provided by sections of tubing 121, 123, 125 having the desired cross-sectional areas. As shown in FIG. 14, the sections 121, 123, 125 of tubing, of the same length but of different cross-sectional areas, can be arranged and maintained in abutting relationship, with their rear walls 15F, 17F, 19F aligned, and in descending order of size, by rigid mounting bars 129 extending across the backs of the tube sections. The bars 129 are fastened to each of the tube sections by fasteners (not shown) which do not enter into the interior of the tube sections. The bars 129 project past the sides of the outer tube sections 121, 125 to provide means for attaching the holder to a wall or like surface area. Other forms of attachment means could be used to hold the tube sections together. For example, at least two bands of strapping can encircle the tube sections and hold them tightly together. The ends of the tube sections are cut square, or at an angle so the ends of each tube are angled toward each other. Either end of the support can be at the top when mounting the support upright. The ends of the tube sections are partially closed by added end walls forming openings in the ends which can be can be used as inlet or outlet openings. The tube sections could be provided with end wall members 72F similar to end wall member 72A shown in FIG. 7 to provide the end walls 37F, 39F, 41F at one end 31F, 33F, 35F of the tube sections, as shown, forming openings 45F, 47F, 49F. A second end wall member (not shown) would provide end wall members at the other end of the tube sections. The end wall members would also serve, in place of the bars, to hold the tube sections together.

The embodiments of the holders shown employ three containers for storing bags in three different size groups but the holder can be made with two containers if it is desired to separate and store the bags in two different size groups, or with four containers if desired to separate and store the bags in four different size groups. A suitable size for a three container holder would be an overall width of about 9 inches and an overall height of about 20 inches with the largest container having a cross-sectional size of about 4×5 inches; the intermediate container having a cross-sectional size of about 3×4 inches and the smallest container having a cross sectional size of about 2×3 inches.

The containers in the holder have been shown as having a rectangular cross-sectional shape but they could have other cross-sectional shapes as well such as square, hexagonal, octagonal or even round or oval. The containers have been shown adjacent with their back walls aligned, the containers joined to form the holder. The aligned back walls make mounting of the holder easier. A holder with more than two containers could have only the back walls of the two outside containers aligned. The containers could also be grouped instead of aligned. For example, three tubular containers, each having a circular cross-section with a different diameter from the other two, could be joined with each container touching the other two with their longitudinal axis parallel.

The containers have been shown as being the same length but varying in size by varying their cross-sectional area. The containers have varied their size by varying both their width and depth. The containers could however vary their size by varying their width only and having the same depth, or by varying their depth only and having the same width.

The holder has been shown with the containers having the openings at their ends. In another embodiment, the containers could each have at least the bottom opening formed in the bottom of the front wall adjacent the bottom end of the container. The top opening in each container could also be formed in the top of the front wall adjacent the top end of the container. The top and bottom ends of the containers would be closed by top and bottom end walls. With similar top and bottom openings, the holder could be inverted providing adjustability in mounting it.

The holder has been shown and described as being used with the containers in a vertical position, and preferably invertable so that either end of the holder can be at the top. However a holder, having rear walls, can also be mounted in a horizontal position, as under a cupboard. The holder, with rear walls, can also be loaded or unloaded with a bag while being hand held, the holder free standing or lying on a horizontal surface when not in use.

I claim:

1. A holder for used plastic bags having at least two tubular containers, one container larger than the other; the one larger container used for storing larger bags than the bags stored by the other container; one end of each container partially closed by a first end wall extending forwardly from the rear of the container toward the front of the container to form a first opening in the container end between the first end wall and the front of the container for passing bags into or out of the container; the other end of each container partially closed by a second end wall extending forwardly from the rear of the container toward the front of the container to form a second opening in the container between the second end wall and the front of the container for passing bags into or out of the container; the first and second openings in each container being at least large enough for a user to insert his thumb and a finger within the container to be able to withdraw a bag from within the container; and a longitudinal slot in each container between the openings allowing a member to be inserted into the container to move bags within the container toward either opening.

2. A holder as claimed in claim 1 wherein each end, in each container, including its end wall, is angled from the rear of the container toward the other end of the container, the end at an angle of between 15° and 45° to a first plane passing transversely to the longitudinal axis of the container from where the end joins the rear of the container.

3. A holder as claimed in claim 1 wherein the end wall at each end of each container is within the container, spaced a short distance from the end of the container, the end wall angled from the rear of the container toward the other end of the container, the end wall at an angle of between 15° and 45° to a first plane passing transversely to the longitudinal axis of the container from where the one end joins the rear of the container.

4. A holder as claimed in claim 1 wherein the containers each have a quadrangular, cross-sectional shape with front and rear walls joined by side walls, the rear walls of the containers aligned, the front walls staggered.

5. A holder as claimed in claim 4 wherein the front wall in each container is curved outwardly and the free edge of the end wall is curved inwardly.

6. A holder as claimed in claim 2 wherein the containers each have a quadrangular, cross-sectional shape with front and rear walls joined by side walls, the rear walls of the containers aligned, the front walls staggered.

7. A holder as claimed in claim 6 wherein the front wall in each container is curved outwardly and the free edge of the end wall is curved inwardly.

8. A holder as claimed in claim 3 wherein the containers each have a quadrangular, cross-sectional shape with front and rear walls joined by side walls, the rear walls of the containers aligned, the front walls staggered.

9. A holder as claimed in claim 8 wherein the front wall in each container is curved outwardly and the free edge of the end wall is curved inwardly.

* * * * *